US007359524B2

(12) United States Patent
Bordewijk

(10) Patent No.: US 7,359,524 B2
(45) Date of Patent: Apr. 15, 2008

(54) HEARING AID ASSEMBLY

(75) Inventor: Lourens George Bordewijk, Den Haag (NL)

(73) Assignee: Koninlijke Philips Electronics N.V., Eindhoven (NL)

( * ) Notice: Subject to any disclaimer, the term of this patent is extended or adjusted under 35 U.S.C. 154(b) by 494 days.

(21) Appl. No.: 10/497,655

(22) PCT Filed: Dec. 9, 2002

(86) PCT No.: PCT/NL02/00806

§ 371 (c)(1),
(2), (4) Date: Jun. 4, 2004

(87) PCT Pub. No.: WO03/049496

PCT Pub. Date: Jun. 12, 2003

(65) Prior Publication Data

US 2004/0247147 A1 Dec. 9, 2004

(30) Foreign Application Priority Data

Dec. 7, 2001 (NL) ..... 1019518

(51) Int. Cl.
*H04R 25/00* (2006.01)

(52) U.S. Cl. ..... 381/322; 381/324

(58) Field of Classification Search ..... 381/322, 381/324, 328, 381

See application file for complete search history.

(56) References Cited

U.S. PATENT DOCUMENTS

| | | | | |
|---|---|---|---|---|
| 4,548,082 | A | 10/1985 | Engebretson et al. | |
| 4,716,985 | A * | 1/1988 | Haertl | 181/130 |
| 4,870,688 | A * | 9/1989 | Voroba et al. | 381/60 |
| 4,961,230 | A | 10/1990 | Rising | |
| 5,500,901 | A * | 3/1996 | Geraci et al. | 381/323 |
| 6,319,020 | B1 | 11/2001 | Brimhall et al. | |
| 6,940,988 | B1 * | 9/2005 | Shennib et al. | 381/322 |
| 6,993,142 | B2 * | 1/2006 | Bordewijk | 381/323 |

* cited by examiner

*Primary Examiner*—Suhan Ni
(74) *Attorney, Agent, or Firm*—Young & Thompson

(57) ABSTRACT

System including a CIC hearing aid that is constructed from a first universal part containing microphone, amplifier and loudspeaker and a second part that is adapted to the auditory canal of the patient. The hearing aid is of a digitally programmable design. The programming is carried out by way of a cable. Since a connection to the first part is not easy to make on account of lack of space, it is proposed to use an auxiliary part that replaces the first part and is used for establishing the desired amplifier characteristics. The desired amplifier characteristics obtained in this way are transmitted to the first part to be used by the patient by contacts that are accessible when the aid is removed from the ear.

11 Claims, 2 Drawing Sheets

HEARING AID ASSEMBLY

BACKGROUND OF THE INVENTION

1. Field of the Invention

The present invention relates to a hearing aid for fitting deep inside the auditory canal of the user (CIC). Numerous attempts have been made to develop such hearing aids. The applicant has been successful in this and is now in a position to offer hearing aids comprising a universal amplifier part and a cover that is adapted to the auditory canal of the patient and is connected to the amplifier part in order to form the hearing aid.

2. Description of the Related Art

Such hearing aids work entirely satisfactorily and overcome the drawbacks known from the prior art. However, there is a trend towards designing amplifiers of such hearing aids so that they are digitally programmable. This makes it possible in a simple manner to adapt specifically to the requirements and impairments of the user.

Although it is suggested in the patent literature that such programming be produced wirelessly, there are still many drawbacks to this at the present time. On the other hand, it is not easily possible to provide a detachable cable connection between the amplifier part and an adjusting external central computer. In particular, it is not possible to use such a cable when further conditions are otherwise unchanged, in other words when the hearing aid is inserted in the auditory canal in the usual way. These problems are caused primarily by the fact that a hearing aid inserted deep inside the auditory canal has very small dimensions. Besides, a number of users require it to be possible to switch off the hearing aid from the outside. This means that both the sound inlet and such a switch have to be fitted on the head end face of the amplifier part that faces outwards.

SUMMARY OF THE INVENTION

It is the object of the present invention to provide the hearing aid described above with a digital, programmable amplifier and to make it possible to program said amplifier in a simple and, above all, reproducible way.

This object is achieved by a system comprising a first part of a CIC aid that is adapted to the auditory canal of the user, a second part of a CIC aid that is designed to be connected to said first part during normal use of the hearing aid and comprises a microphone and amplifier, which amplifier is digital and programmable, said second part comprising contacts for said programming, and an auxiliary part that is designed to be connected to said first part during the setting of the hearing aid and comprises a microphone and amplifier and also a cable (connection).

According to the invention, advantageous use is made of the applicant's idea of constructing a hearing aid of two parts, an amplifier part that is universal, and an individualized cover that is connected to the amplifier part and provides engagement with the auditory canal of the user. Apart from the advantages known earlier in the prior art, it is possible with the present invention to replace the amplifier part of the user during setting of the amplifier with an auxiliary part held by the audiologist or another person who is performing the setting operations. This part is of a substantially identical design to that of the amplifier part, but is provided with the abovementioned connection or connecting cable, which is necessary for connection to an adjusting central computer. In the case of hearing aids with an on/off switch such a cable may be provided at the position of the on/off switch. The microphone of the auxiliary part is preferably placed in the same position as the microphone of the second or amplifier part that is being used by the user. By making all essential variables of the auxiliary part substantially identical to those of the amplifier part, it is guaranteed that the setting conditions are identical. The cover to be slid onto the second part is also used for the auxiliary part, in other words the same part that is adapted to the auditory canal of the patient is used during the adjustments.

After or during the optimization of the amplifier of the auxiliary part, these data are input into the amplifier of the second part of the actual hearing aid. This input of data according to the present invention is performed by way of contacts. These contacts can comprise an additional contact and/or the battery contacts. It will also suffice to have only the battery contacts and to set the digital amplifier for the programming by means of multiplex techniques.

It is possible to fit the contacts at a place that is not accessible when the hearing aid has been fitted in the auditory canal.

However, the contact is, or the contacts are, advantageously fitted on the front end wall at the head end of the part of the hearing aid containing the electronics. Such contacts may be of extremely small dimensions. This applies in particular to their depth. A plug needs a depth of at least 2 mm, with the result that the length of the aid increases accordingly. In the case of CIC aids the length is extremely important, so that such an increase in length is undesirable. The contacts according to the present invention can simply be made of a metal part with a thickness of, for example, 0.1-0.3 mm. The surface area of such contacts can be small. If these contacts are of a circular design, a figure of approximately 2 mm is given as an example. Furthermore, it is possible to fit the contact in a slightly recessed manner (a few tenths of a mm), so that it can be closed off with a closure cap. It will be understood that, instead of a single contact designed in the manner described above, two or more contacts may be present. A second contact may be fitted in a different position from that of the first contact.

According to an advantageous variant of the system described above, a connecting piece is present, into which connecting piece the amplifier part or second part of the actual hearing aid can be inserted, and by means of which connection is made to the programming contacts present in said part.

The invention also relates to a hearing aid for fitting in the auditory canal of a person, comprising a first part that is adapted to the auditory canal of the user, a second part that is designed to be connected to said first part during normal use of the hearing aid and comprises a microphone and amplifier, which amplifier is digital and programmable, said second part comprising contacts for said programming, and said contacts being covered relative to the environment when first and second part have been connected. More particularly, said aid is provided with an on/off switch near the head end face.

The invention also relates to a method for programming a hearing aid, comprising placing an auxiliary part with a microphone and digital, programmable amplifier in the ear, optimizing the amplifier setting by way of an external connection and central computer, and transmitting said optimized amplifier setting to an amplifier of a second part of said hearing aid, followed by the connection of said second part of the hearing aid to a first individualized part of the hearing aid.

The invention will be explained in greater detail below with reference to an exemplary embodiment illustrated in the drawing, in which:

DETAILED DESCRIPTION OF THE PREFERRED EMBODIMENTS

Figure 1:
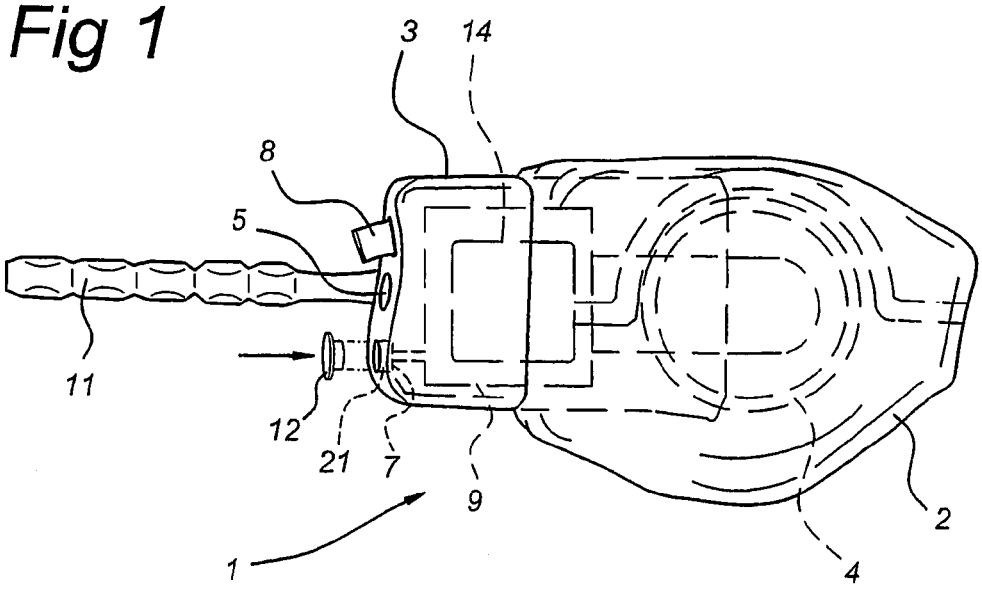
FIG. 1 shows diagrammatically and partially in cross section a hearing aid according to the invention.

A hearing aid is indicated by 1 in FIG. 1. This hearing aid is composed of a cover 2, which is adapted externally to the shape of the auditory canal. For an example of such an adaptation, reference is made to the PCT application PCT/NL02/00100. However, it should be understood that the manner of adaptation is not relevant to the present invention. The cover encloses one end of the amplifier part 3. By removing the cover 2 from amplifier part 3, the relatively large battery 4 is exposed. The remaining space in the cover 2 is available for the accommodation of a sound tube and/or the accommodation of ear wax.

Figure 2:
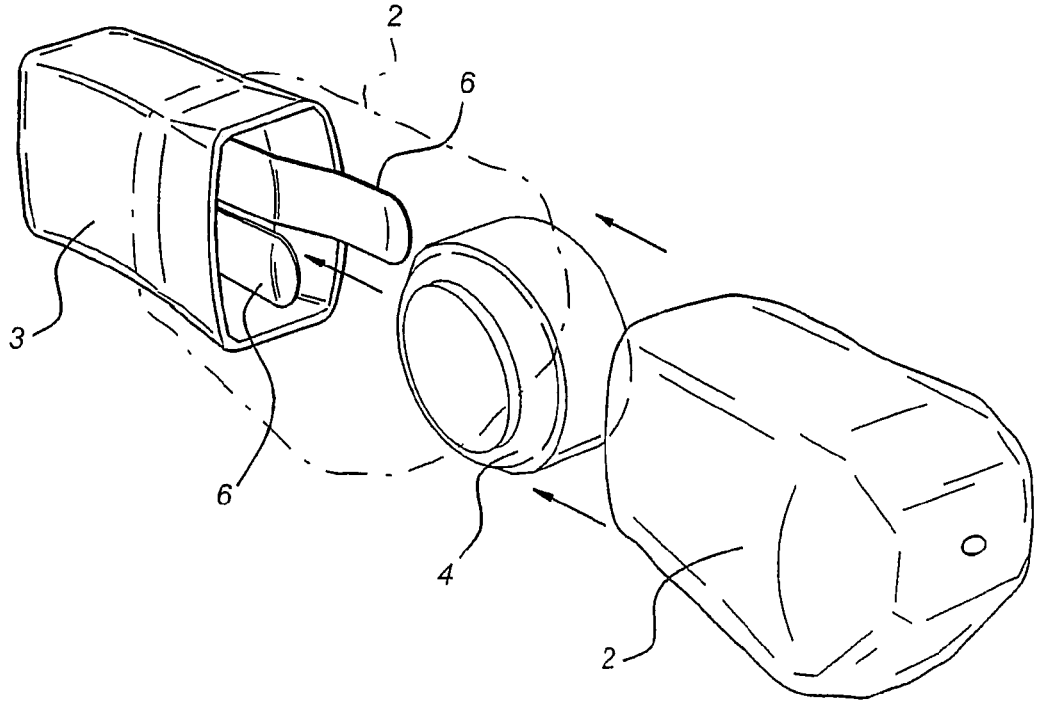
FIG. 2 shows an end view of the first part.

The amplifier part 3 is provided with a microphone 5, which is preferably fitted centrally, so that the amplifier part 3 can be used for either the left or the right ear. The microphone 5 is placed directly against the end face. An on/off switch 8 is also present, and there is a pull cord 11 for removing the hearing aid 1 from the ear. Reference numeral 9 indicates a digitally programmable amplifier, and 14 indicates a loudspeaker, which is connected to a sound tube in a manner not shown in any further detail. A contact situated on the front side of the amplifier part 3 is indicated by 7. In FIG. 2 the battery contacts are indicated by 6. It can be seen from the arrangement according to FIGS. 1 and 2 that when cover 2 is slid over the amplifier part both the battery and the contacts 6 belonging to it are covered.

As can be seen from FIG. 1, the contact 7 is fitted on the head end wall. This contact 7 is composed of a thin metal plate with a thickness of preferably 0.1 mm. As shown, contact 7 lies in a recess 21 on which a closure cap 12 can be placed. The diameter of the metal plate 7 is approximately 2 mm (circular). Instead of a single contact, two contacts designed in this way may be fitted.

Figure 3:
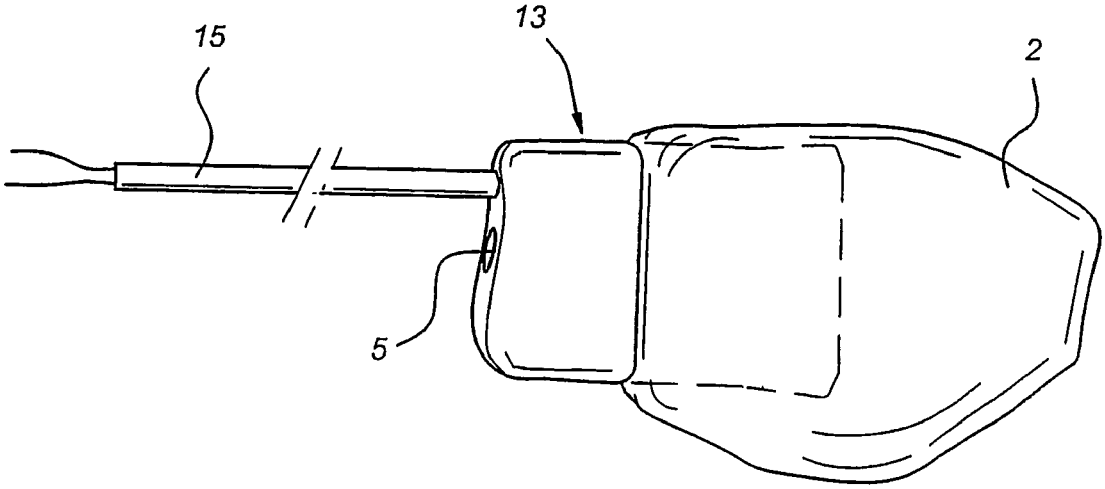
FIG. 3 shows diagrammatically the auxiliary part according to the invention combined with an individualized cover.

An auxiliary part 13 is shown in FIG. 3. The construction of this auxiliary part, insofar as it is of importance here, corresponds to the amplifier part 3 described above. The microphone is fitted in the same position. A connecting cable 15 is now provided instead of the on/off switch 8. Auxiliary part 13 can be connected to cover 2 in the same way as amplifier part 3.

Figure 4:
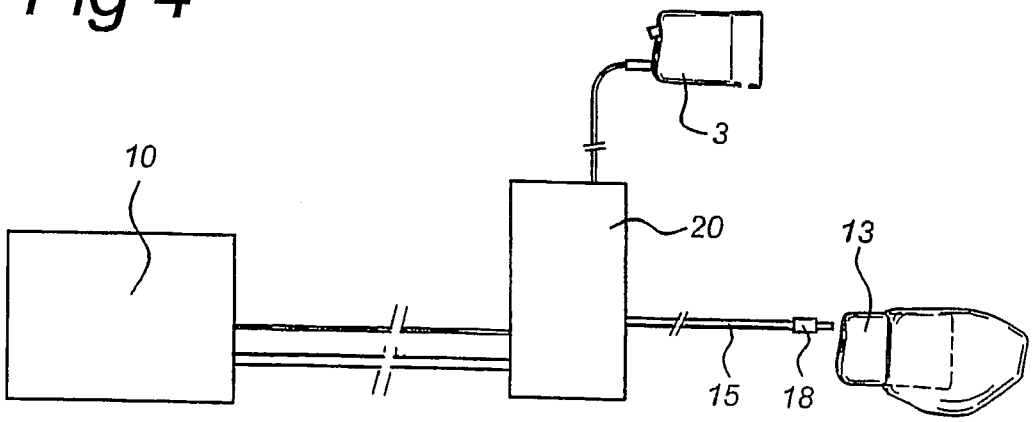
FIG. 4 shows diagrammatically the arrangement during the adjustment of the amplifier of a hearing aid.

A process control arrangement is shown in FIG. 4. This process control arrangement is composed of a central computer or PC 10 and connecting piece 20. The cable 15 extends from the connecting piece 20 and may or may not be connected by way of a detachable connector 18 to the auxiliary part 13. The connecting piece 20 is provided with a socket for accommodating the amplifier part 3.

The construction described above works as follows. After a correctly adapted cover 2 has been obtained, during the first taking of measurements for a hearing aid, auxiliary part 13 is connected to it and placed in the auditory canal of a user. The setting of the amplifier 9 situated in said auxiliary part is then adapted in the optimum way to the requirements and impairments of the user by way of a central computer 10. This setting is transmitted either simultaneously or at a later stage to the amplifier part 3, which is electrically connected to the central computer by way of the connecting piece 20. The auxiliary part 13, covered by cover 2, is then removed from the ear, and the cover 2 is detached from the auxiliary part 13, and cap 12 is removed. The auxiliary part 2 and amplifier part 3, which has been set as desired, are then connected, and the hearing aid can be placed in the auditory canal of the user. If an on/off switch is present, the aid can then be put into use.

With the present invention it is possible to shorten considerably the overall length of the amplifier part 3. A figure of approximately 20%, and more particularly approximately 2.2 mm, is mentioned as an example. This means that the aid is even less visible in the auditory canal.

Although the invention has been described above with reference to a preferred embodiment, variants that lie with the scope of the present claims will immediately spring to mind for the person skilled in the art.

The invention claimed is:

1. A hearing aid to be inserted deep inside an auditory canal (CIC), comprising:

a first part that is adapted to the auditory canal of a user; and a second part (3) that is designed to be connected to said first part during normal use of the hearing aid and removable from said first part during programming of said second part and comprises a microphone and amplifier, said amplifier being digital and programmable, and said second part comprising contacts (6, 7) for said programming.

2. The hearing aid according to claim 1, wherein a free head end face of the second part, said end face facing outwards when in use, is provided with a sound inlet and on/off switching means and at least one of said contacts (6, 7).

3. The hearing aid according to claim 1, wherein said microphone is fitted centrally in said amplifier, whereby said amplifier can be employed for either a left or right ear.

4. The hearing aid according to claim 1, wherein said microphone is placed directly against an end face of said hearing aid.

5. The hearing aid according to claim 1, further comprising a pull cord adapted to remove said hearing aid from an ear.

6. The hearing aid according to claim 1, wherein said contact (7) is a metal plate having a thickness of 0.1 mm.

7. The hearing aid according to claim 6, wherein said metal plate is circular with a diameter of about 2 mm.

8. The hearing aid according to claim 1, wherein said contact (7) is fitted on a head end wall.

9. The hearing aid according to claim 8, wherein said contact (7) lies in a recess in said head end wall.

10. The hearing aid according to claim 9, wherein a closure cap is placed on said recess.

11. The hearing aid according to claim 1, wherein said amplifier has a length of about 2.2 mm.

* * * * *